US006808290B2

(12) United States Patent
Lee

(10) Patent No.: US 6,808,290 B2
(45) Date of Patent: Oct. 26, 2004

(54) LED FLASHLIGHT ASSEMBLY

(76) Inventor: Wen-Sung Lee, 8F-2, No. 60-2. Taichung Industrial Park 1Strd., Hsitun Dist 407, Taichung (TW)

( * ) Notice: Subject to any disclaimer, the term of this patent is extended or adjusted under 35 U.S.C. 154(b) by 0 days.

(21) Appl. No.: 10/292,677

(22) Filed: Nov. 12, 2002

(65) Prior Publication Data

US 2004/0090777 A1 May 13, 2004

(51) Int. Cl.[7] ..... F21L 4/04

(52) U.S. Cl. ..... 362/202; 362/203; 362/205; 362/204; 362/208; 362/171; 362/800; 362/197; 362/244; 362/326; 362/545; 362/241

(58) Field of Search ..... 362/202, 203, 362/204, 205, 208, 171, 184, 800, 197, 244, 326, 545, 241

(56) References Cited

U.S. PATENT DOCUMENTS 6,168,288 B1 * 1/2001 St. Claire ..... 362/184

6,190,020 B1 * 2/2001 Hartley ..... 362/184

* cited by examiner

*Primary Examiner*—Stephen Husar
*Assistant Examiner*—Bertrand Zeade
(74) *Attorney, Agent, or Firm*—Charles E. Baxley

(57) ABSTRACT

An LED flashlight assembly includes a body, a battery seat mounted in the body and provided with a plurality of LEDs, and a lamp seat mounted on the body and formed with a plurality of through holes for passage of the LEDs of the battery seat. The lamp seat is formed with an arcuate catch edge encompassing the periphery of the through holes. Thus, the arcuate catch edge encompasses the periphery of the through holes, so as to refract the beams of refracted and dispersed light emitted from the LEDs, so that the beams of refracted and dispersed light emitted from the LEDs are concentrated, collected and integrated into the beams of flat and smooth light, thereby enhancing the brightness of the LED flashlight assembly.

5 Claims, 9 Drawing Sheets

LED FLASHLIGHT ASSEMBLY

BACKGROUND OF THE INVENTION

1. Field of the Invention

The present invention relates to an LED (light emitting diode) flashlight assembly, and more particularly to an LED flashlight assembly, wherein the lamp seat is formed with an arcuate catch edge encompassing the periphery of the through holes of the lamp seat, so as to concentrate and collect the beams of light that are refracted and dispersed.

2. Description of the Related Art

A conventional LED flashlight assembly in accordance with the prior art shown in FIGS. 1 and 2 comprises a body 1, a battery seat 2 mounted in the body 1, a lamp seat 3 mounted in the body 1, a plurality of LEDs 5 mounted oh the lamp seat 3, a support seat mounted on the lamp seat 3 and formed with a plurality of through holes 6 for passage of the LEDs 5, and a lamp shade 4 mounted on the body 1. As shown in FIGS. 1 and 2, the beams of light emitted from the LEDs 5 are refracted in different angles by the wall 7 of the lamp shade 4, so that the beams of light emitted from the LEDs 5 cannot be concentrated and collected, thereby decreasing the brightness of the conventional LED flashlight assembly.

SUMMARY OF THE INVENTION

The present invention has arisen to mitigate and/or obviate the disadvantage of the conventional LED flashlight assembly.

The primary objective of the present invention is to provide an LED flashlight assembly, wherein the lamp seat is formed with an arcuate catch edge encompassing the periphery of the through holes of the lamp seat, so as to concentrate and collect the beams of light that are refracted and dispersed.

Another objective of the present invention is to provide an LED flashlight assembly, wherein the arcuate catch edge of the lamp seat encompasses the periphery of the through holes, so as to refract the beams of refracted and dispersed light emitted from the five LEDs of the battery seat, so that the beams of refracted and dispersed light emitted from the five LEDs of the battery seat are concentrated, collected and integrated into the beams of flat and smooth light, thereby enhancing the brightness of the LED flashlight assembly in accordance with the present invention.

In accordance with the present invention, there is provided an LED flashlight assembly, comprising:

a body;

a battery seat, mounted in the body and provided with a plurality of LEDs; and a lamp seat, mounted on the body and formed with a plurality of through holes for passage of the LEDs of the battery seat;

wherein, the lamp seat is formed with an arcuate catch edge encompassing the periphery of the through holes, so as to concentrate and collect the beams of light that are emitted from the LEDs of the lamp seat and are refracted and dispersed.

Further benefits and advantages of the present invention will become apparent after a careful reading of the detailed description with appropriate reference to the accompanying drawings.

DETAILED DESCRIPTION OF THE INVENTION

Figure 1:
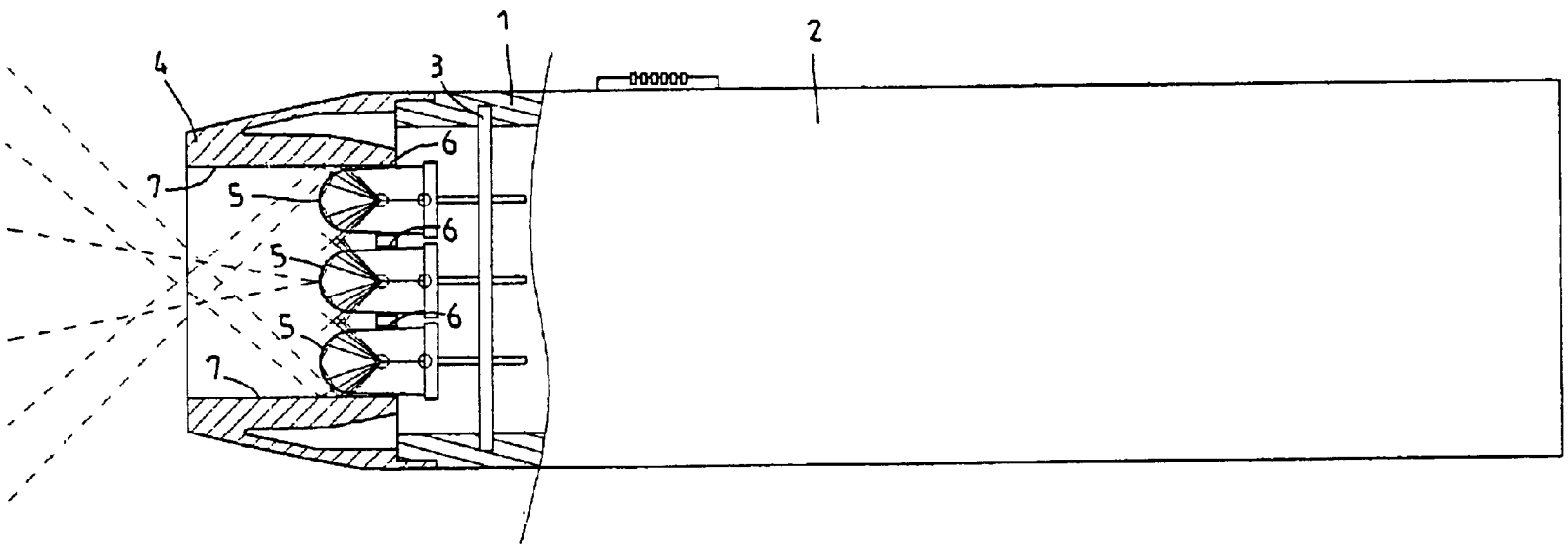
FIG. 1 (PRIOR ART)
FIG. 1 is a side plan partially cross-sectional view of a conventional LED flashlight assembly in accordance with the prior art.
Figure 2:
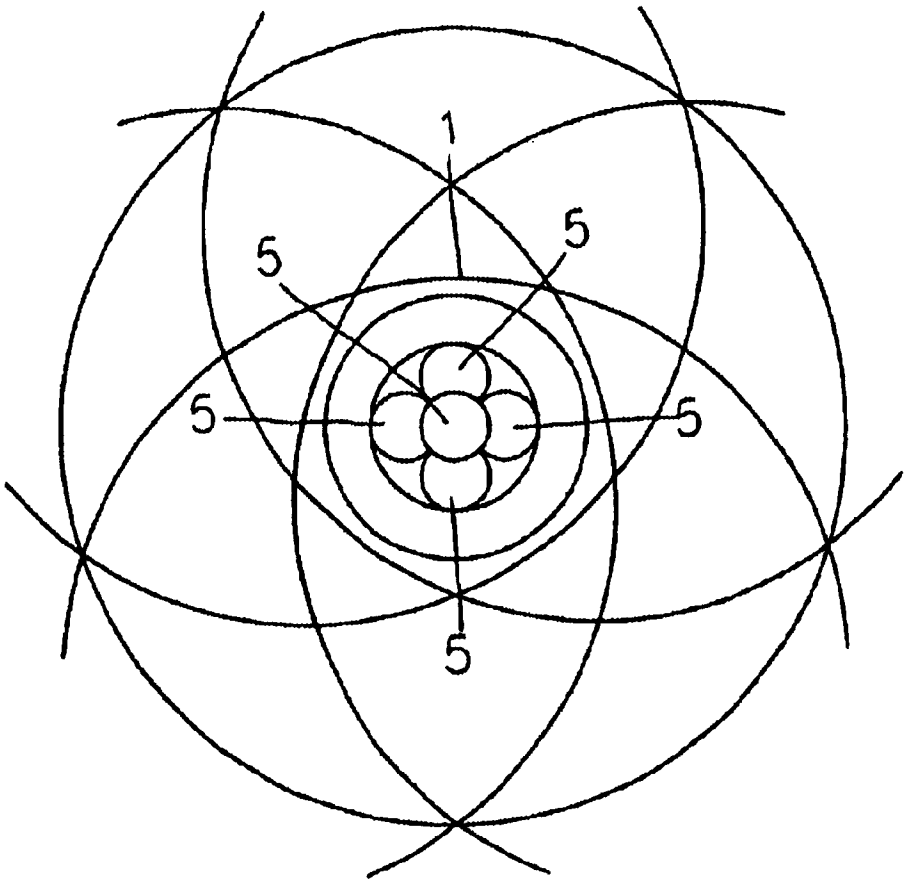
FIG. 2 (PRIOR ART)
FIG. 2 is a schematic front plan view of the conventional LED flashlight assembly as shown in FIG. 1 in use.
Figure 3:
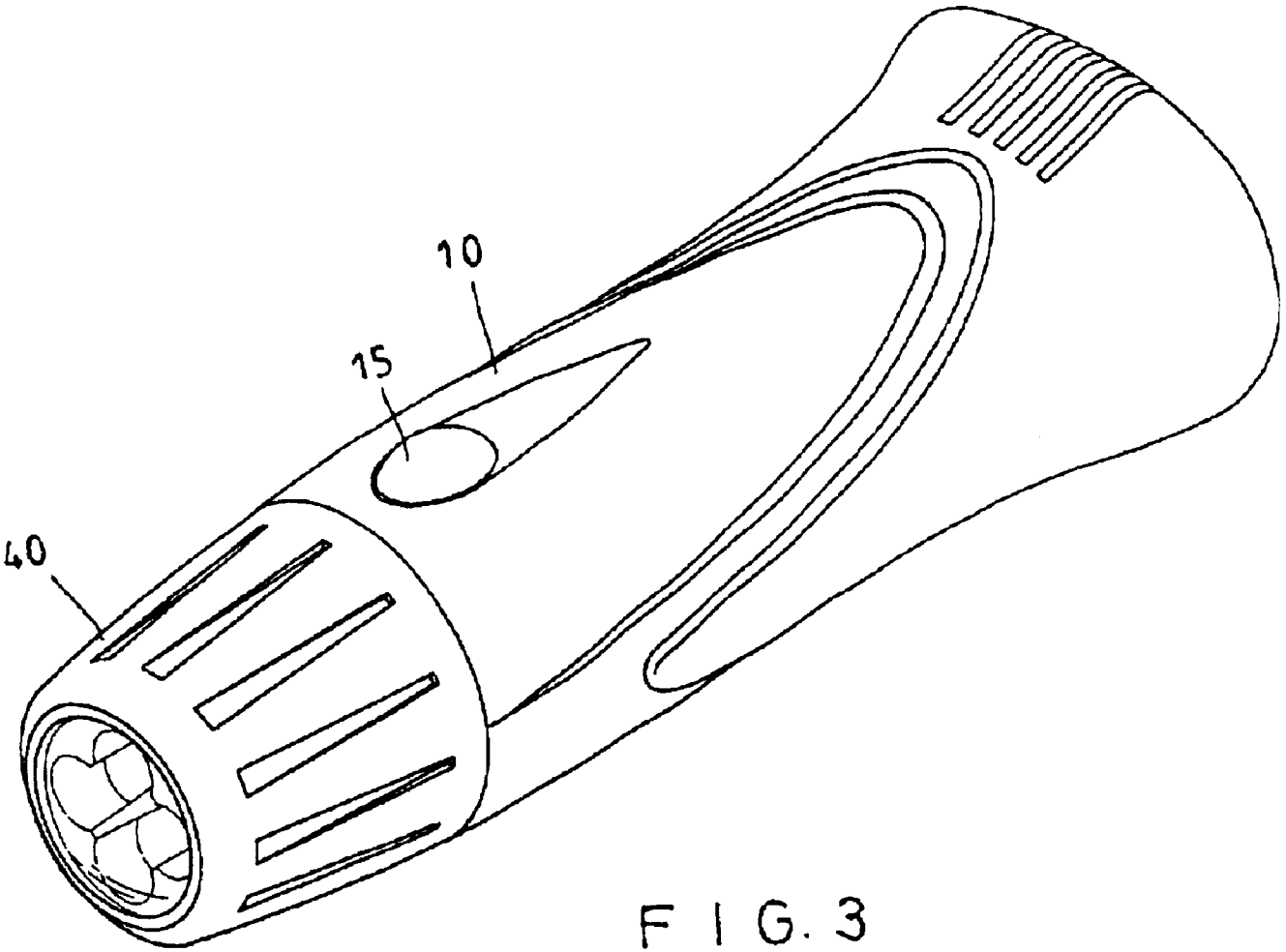
FIG. 3 is a perspective view of an LED flashlight assembly in accordance with a preferred embodiment of the present invention.

Referring to the drawings and initially to FIGS. 3–6, an LED flashlight assembly in accordance with a first embodiment of the present invention comprises a body 10, a battery seat 20, a lamp seat 30, and a lamp shade 40.

The body 10 has an inner wall formed with a receiving space 11 having a closed first end and an opened second end formed with an opening 12. The opening 12 of the body 10 has a peripheral wall formed with a locking groove 13 which has two opposite ends each formed with an arcuate breach 14. The body 10 has an outer wall provided with a push button 15 that may be inserted into the receiving space 11 of the body 10.

Figure 5C:
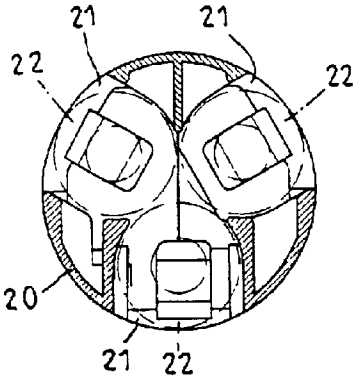
FIG. 5C is a cross-sectional view of the LED flashlight assembly taken along line 5C—5C as shown in FIG. 5.

The battery seat 20 is cylindrical shaped, and is mounted in the receiving space 11 of the body 10. The battery seat 20 has a peripheral wall formed with three receiving slots 21 for receiving three batteries 22 (see FIG. 5C). The battery seat 20 is provided with an IC circuit board 23, five LEDs 24, and a switch 25. Thus, the push button 15 of the body 10 may be used to control operation of the switch 25 of the battery seat 20, to conduct the electric power of the three batteries 22, so as to light the five LEDs 24 by the IC circuit board 23, or to shut the electric power of the three batteries 22, so as to extinguish the five LEDs 24 by the IC circuit board 23. The battery seat 20 has an outer wall formed with a stepped edge 26. Preferably, the stepped edge 26 of the battery seat 20 has a periphery formed with a plurality of positioning grooves 27.

The lamp seat 30 is hollow, and is mounted on the stepped edge 26 of the battery seat 20. The lamp seat 30 has an inner wall formed with a plurality of inner positioning strips 31

Figure 4:
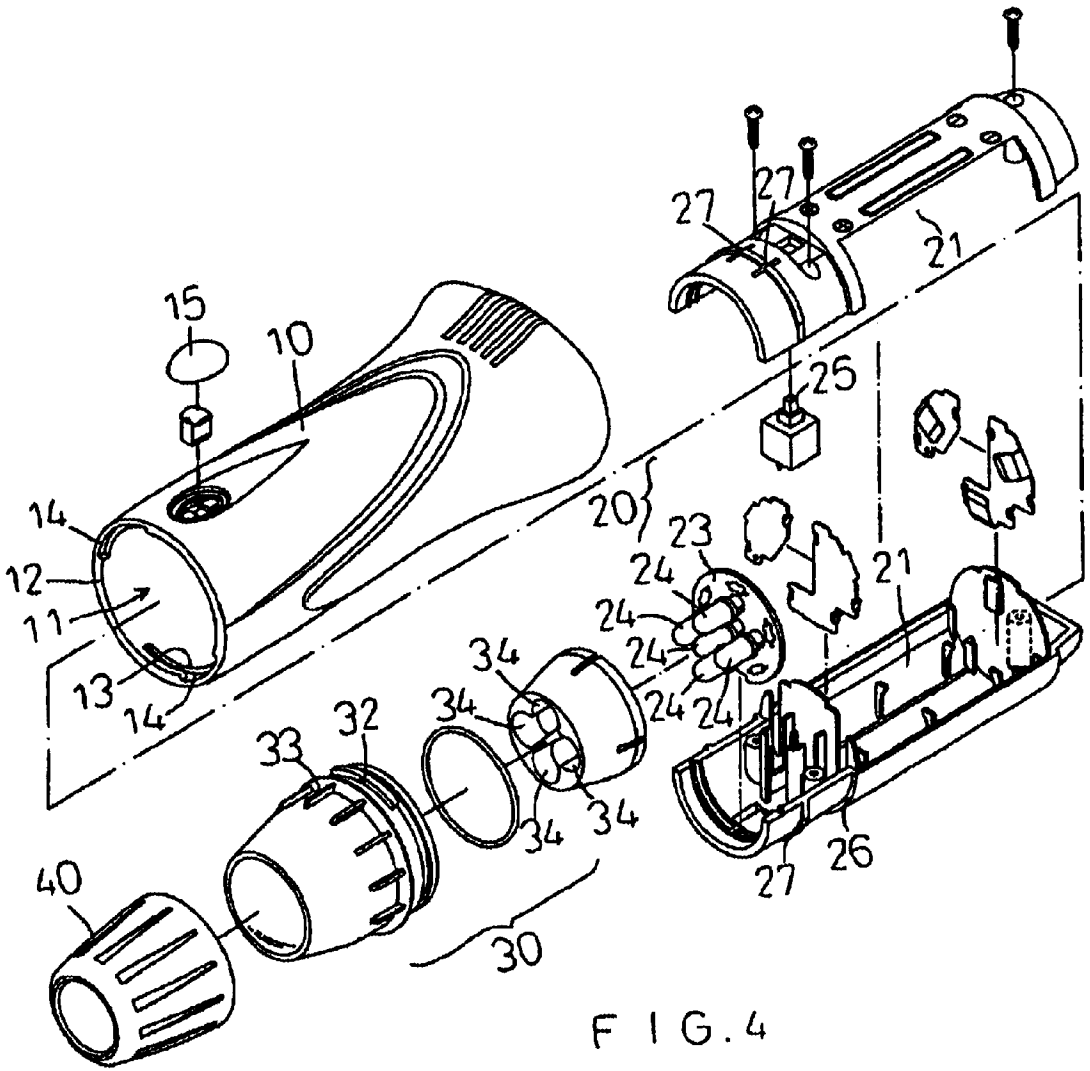
FIG. 4 is an exploded perspective view of the LED flashlight assembly in accordance with the preferred embodiment of the present invention.
Figure 4B:
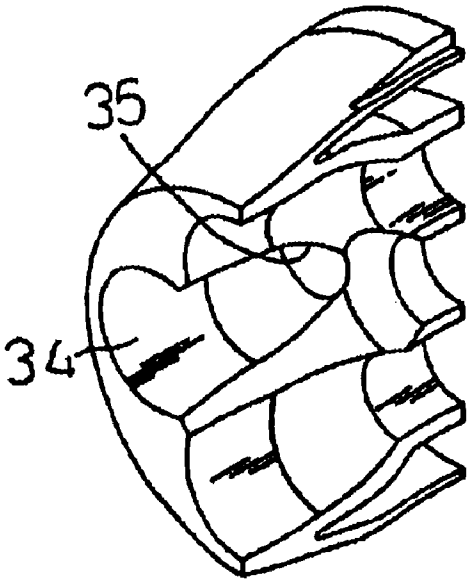
FIG. 4B is a partially cut-away enlarged view of the LED flashlight assembly as shown in FIG. 4.
Figure 4A:
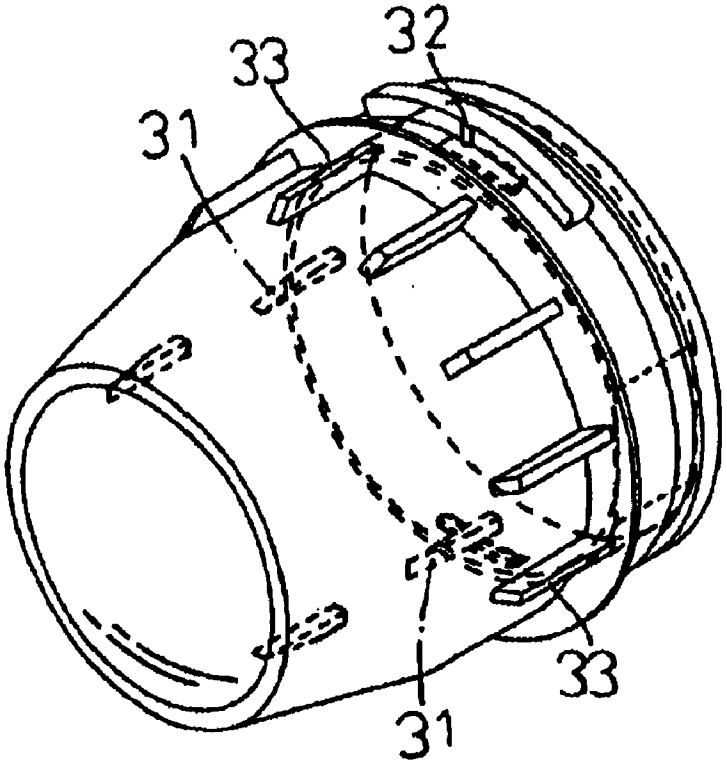
FIG. 4A is a partially enlarged view of the LED flashlight assembly as shown in FIG. 4.
Figure 5B:
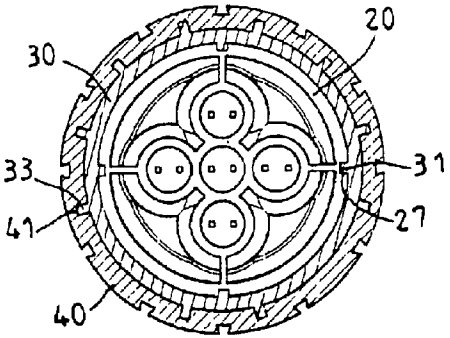
FIG. 5B is a cross-sectional view of the LED flashlight assembly taken along line 5B—5B as shown in FIG. 5.
Figure 6:
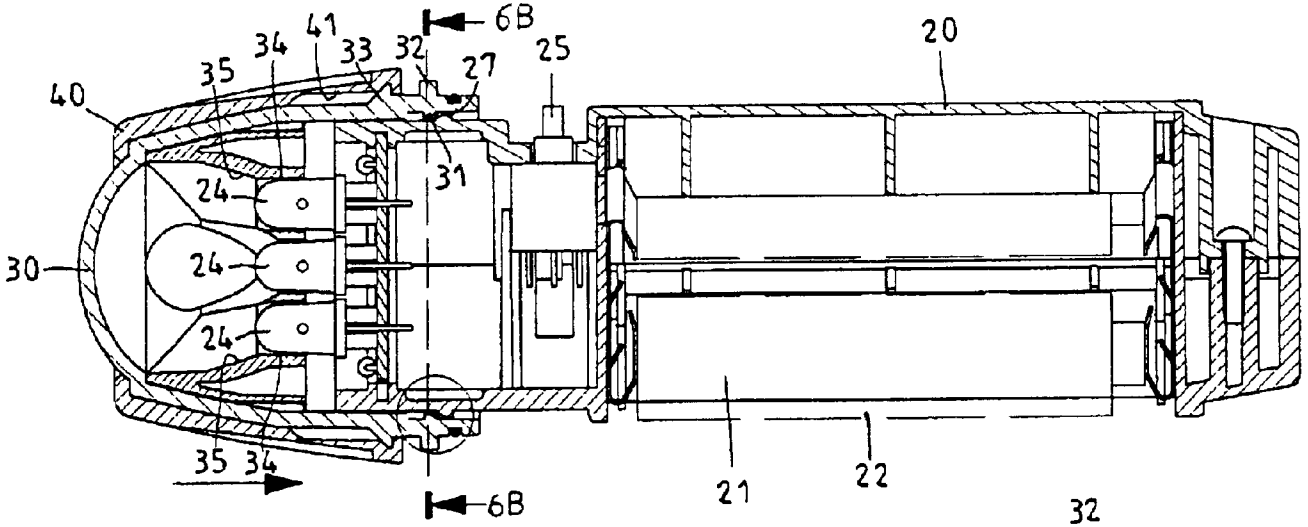
FIG. 6 is a side plan cross-sectional view of the LED flashlight assembly as shown in FIG. 3.
Figure 6B:
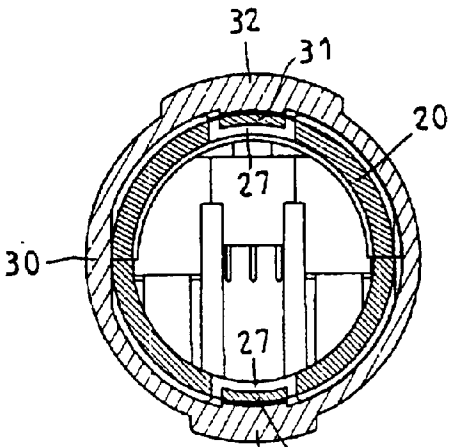
FIG. 6B is a cross-sectional view of the LED flashlight assembly taken along line 6B—6B as shown in FIG. 6.
Figure 6A:
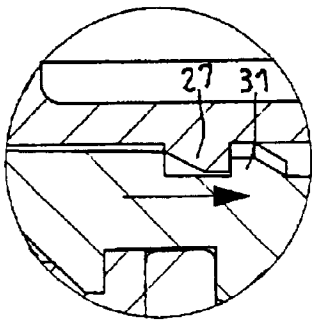
FIG. 6A is a partially enlarged view of the LED flashlight assembly as shown in FIG. 6.

(see FIGS. 4A and 5B) each secured in a respective one of the positioning grooves 27 of the stepped edge 26 of the battery seat 20 as shown in FIGS. 5B, 6A and 6B. The lamp seat 30 has an outer wall formed with two opposite arcuate locking tenons 32 each aligning with the arcuate breach 14 of each of the two opposite ends of the locking groove 13 of the body 10. Thus, when the lamp seat 30 is inserted into the receiving space 11 of the body 10, each of the two opposite arcuate locking tenons 32 of the lamp seat 30 is initially inserted into the arcuate breach 14 of each of the two opposite ends of the locking groove 13 of the body 10. Then, the lamp seat 30 is rotated relative to the body 10, so that each of the two opposite arcuate locking tenons 32 of the lamp seat 30 is rotated and inserted into the locking groove 13 of the body 10, so that the lamp seat 30 is locked on the body 10. The outer wall of the lamp seat 30 is formed with a plurality of outer positioning strips 33. The lamp seat 30 is formed with five through holes 34 for passage of the five LEDs 24 of the battery seat 20. Preferably, the five LEDs 24 of the battery seat 20 are arranged in a cruciform shape, and the five through holes 34 of the lamp seat 30 are arranged in a cruciform shape. The lamp seat 30 is formed with an arcuate catch edge 35 (see FIGS. 4B and 5) encompassing the periphery of the five through holes 34, so as to concentrate and collect the beams of light that are refracted and dispersed.

Figure 5A:
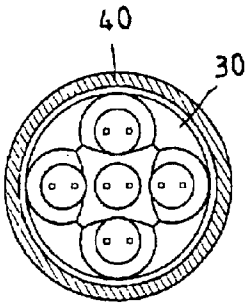
FIG. 5A is a cross-sectional view of the LED flashlight assembly taken along line 5A—5A as shown in FIG. 5.
Figure 5:
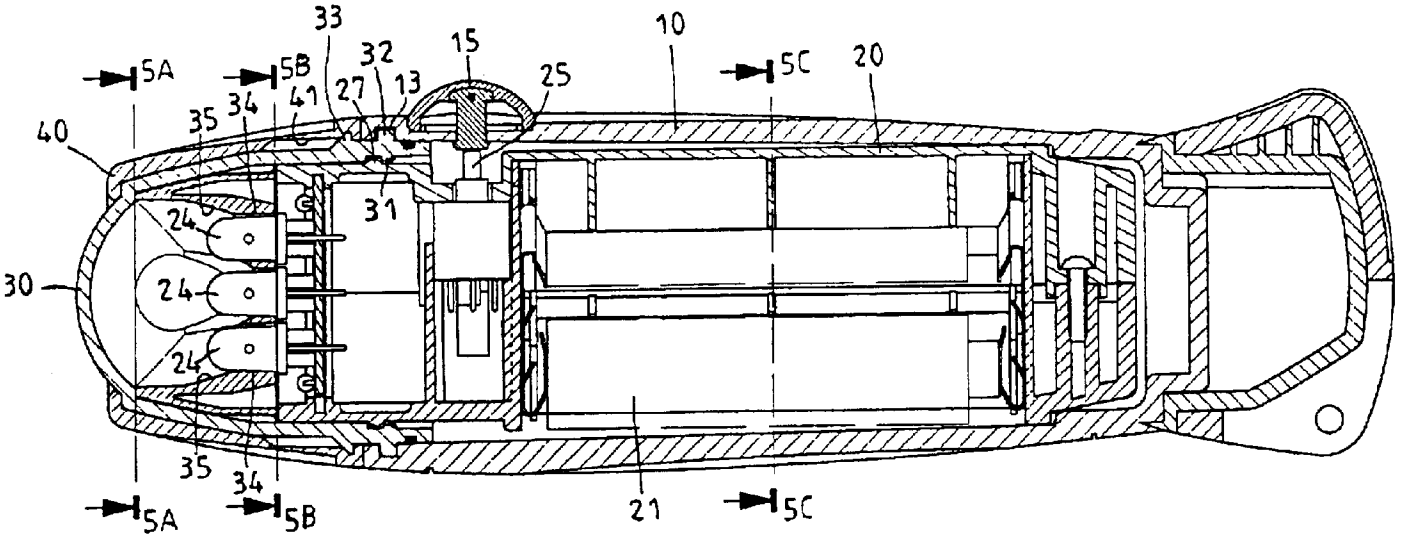
FIG. 5 is a side plan cross-sectional view of the LED flashlight assembly as shown in FIG. 3.

The lamp shade 40 is a hollow cone, and is mounted on the lamp seat 30 as shown in FIG. 5A. The lamp shade 40 has an inner wall formed with a plurality of positioning grooves 41 for positioning and locking the plurality of outer positioning strips 33 of the lamp seat 30.

Figure 7:
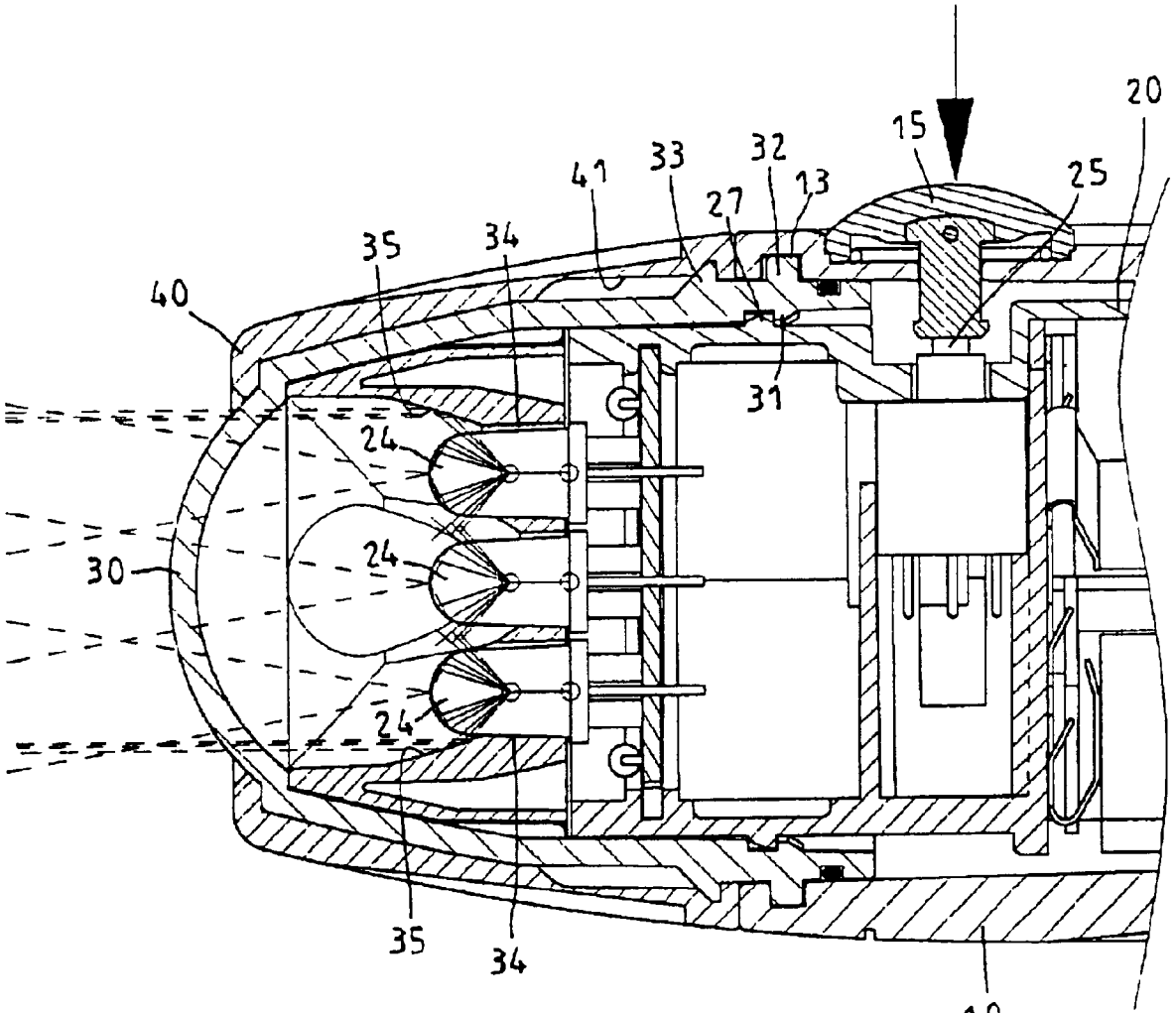
FIG. 7 is a partially cut-away schematic operational view of the LED flashlight assembly as shown in FIG. 5 in use.

In operation, referring to FIG. 7, the push button 15 of the body 10 is pushed to conduct the switch 25 of the battery seat 20, to conduct the electric power of the three batteries 22 which supply the electric power so as to light the five LEDs 24 by the IC circuit board 23.

Figure 8:
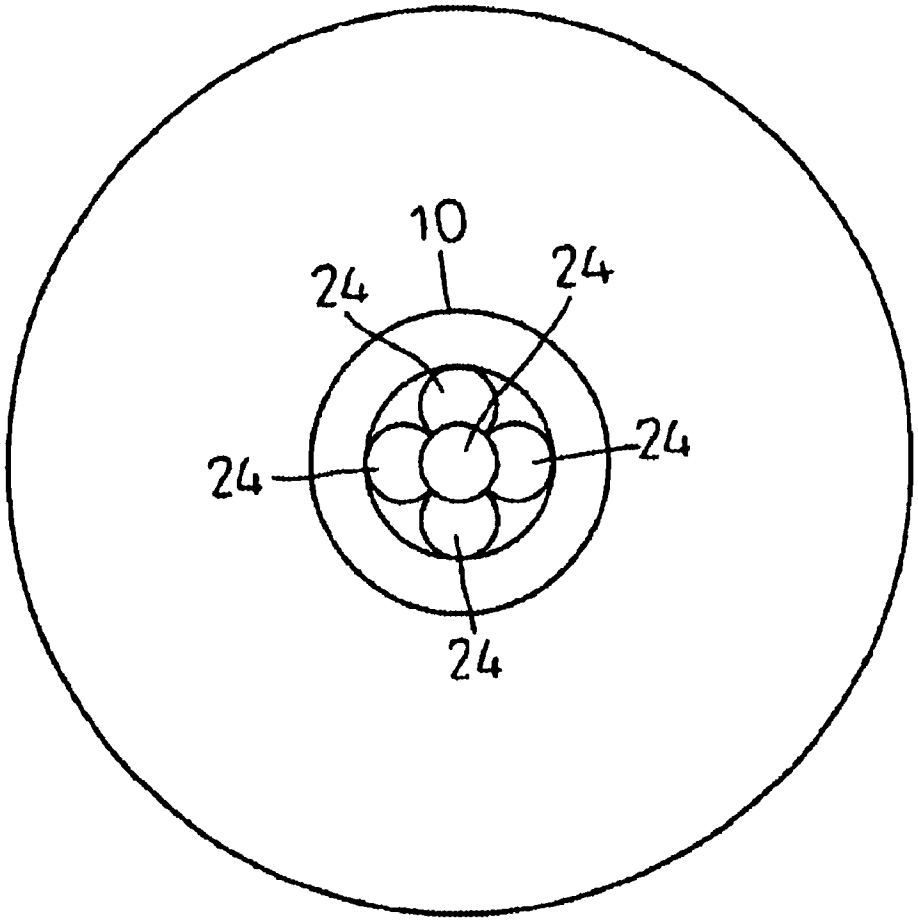
FIG. 8 is a schematic front plan view of the LED flashlight assembly as shown in FIG. 3 in use.

As shown in FIGS. 7 and 8, the arcuate catch edge 35 of the lamp seat 30 encompasses the periphery of the five through holes 34, so as to refract the beams of refracted and dispersed light emitted from the five LEDs 24 of the battery seat 20, so that the beams of refracted and dispersed light emitted from the five LEDs 24 of the battery seat 20 are concentrated, collected and integrated into the beams of flat and smooth light, thereby enhancing the brightness of the LED flashlight assembly in accordance with the present invention.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An LED flashlight assembly, comprising:

a body;

a battery seat, mounted in the body and provided with a plurality of LEDs; and a lamp seat, mounted on the body and formed with a plurality of through holes for receiving the LEDs of the battery seat;

wherein, the lamp seat is formed with an arcuate catch edge connected to and encompassing the periphery of the through holes, so as to concentrate and collect the beams of light that are emitted from the LEDs of the lamp seat and are refracted and dispersed.

2. The LED flashlight assembly in accordance with claim 1, wherein the body has an inner wall formed with a receiving space having a closed first end and an opened second end formed with an opening, the opening of the body has a peripheral wall formed with a locking groove which has two opposite ends each formed with an arcuate breach, and the lamp seat has an outer wall formed with two opposite arcuate locking tenons each aligning with and extending through the respective arcuate breach of each of the two opposite ends of the locking groove of the body and each inserted into and locked in the locking groove of the body, so that the lamp seat is locked on the body.

3. The LED flashlight assembly in accordance with claim 1, wherein the battery seat has an outer wall formed with a stepped edge, the stepped edge of the battery seat has a periphery formed with a plurality of elongated positioning grooves, and the lamp seat is mounted on the stepped edge of the battery seat and has an inner wall formed with a plurality of elongated inner positioning strips each secured in a respective one of the positioning grooves of the stepped edge of the battery seat.

4. The LED flashlight assembly in accordance with claim 1, wherein the lamp seat has an outer wall formed with a plurality of elongated outer positioning strips, and the LED flashlight assembly further comprises a lamp shade mounted on the lamp seat and having an inner wall formed with a plurality of elongated positioning grooves for positioning and locking the plurality of outer positioning strips of the lamp seat.

5. The LED flashlight assembly in accordance with claim 1, wherein the LEDs of the battery seat are arranged in a cruciform shape, and the through holes of the lamp seat are arranged in a cruciform shape for matching the LEDs of the battery seat.

* * * * *